United States Patent [19]

Smith

[11] 4,232,281

[45] Nov. 4, 1980

[54] IN-LINE PACKAGE RELAY

[75] Inventor: Philip N. Smith, Cincinnati, Ohio

[73] Assignee: Standex International Corporation, Salem, N.H.

[21] Appl. No.: 911,386

[22] Filed: Jun. 1, 1978

[51] Int. Cl.[3] ..... H01H 1/66; H01H 51/00; H01H 11/02

[52] U.S. Cl. ..... 335/152; 29/622; 335/151

[58] Field of Search ..... 335/151, 152, 153, 154, 335/202; 29/602 R, 622, 605

[56] References Cited

U.S. PATENT DOCUMENTS

| | | | |
|---|---|---|---|
| 3,434,079 | 3/1969 | Ege | 335/151 |
| 3,539,956 | 11/1970 | Andersen et al. | 335/154 |
| 3,638,149 | 1/1972 | Bopp et al. | 335/202 X |
| 3,928,829 | 12/1975 | Abrams | 335/151 |
| 3,940,722 | 2/1976 | Fox et al. | 335/151 |
| 4,063,205 | 12/1977 | Miknaitis | 335/152 X |
| 4,091,346 | 5/1978 | Nishimura et al. | 335/202 X |

FOREIGN PATENT DOCUMENTS

| | | | |
|---|---|---|---|
| 1256328 | 12/1967 | Fed. Rep. of Germany | 335/151 |

*Primary Examiner*—Fred L. Braun

*Attorney, Agent, or Firm*—Wood, Herron & Evans

[57] ABSTRACT

A reed relay wherein the coil and switch terminals are disposed generally in planes parallel to the axis of the relay. A bobbin is molded onto a switch consisting of glass-enclosed contacts with leads projecting therefrom. Coil terminals are molded integrally with the flanges of the bobbin. The coil leads are connected to one side of the terminals which are then bent into notches in the flanges. The switch terminals are formed alternatively by bending them into notches in the bobbin flanges to project at right angles to the axis of the bobbin or by laying a separate terminal in the bobbin and welding the terminals to it. A housing is molded around the bobbin and the respective coil and switch terminals are bent into an in-line position.

13 Claims, 16 Drawing Figures

IN-LINE PACKAGE RELAY

This invention relates to a reed relay, and particularly to a reed relay known in the art as a dual in-line package (DIP), or a single in-lin package (SIP).

Reed relays in general consist of a pair of contacts encapsulated in a glass envelope with a lead or terminal projecting from each end of the envelope, this combination forming a switch. The switch is disposed in a bobbin about which a coil is wound. The coil leads are connected to terminals. The coil terminals and switch terminals are generally bent downwardly with respect to the bobbin so as to project at right angles to the axis of the bobbin at each end of the relay.

The dual in-line package is a reed relay wherein the coil terminals are located on one side of the package and the switch leads are located on the other side of the package as contrasted to the above described relay where the terminals and switch leads are located at the end of the package. Similarly, the single in-line package has all leads depending from one side of the package. These different lead orientations are desirable in order to facilitate the mounting of a reed relay on a printed circuit board and the capability of having leads at different orientations provides the designer with a certain flexibility as far as his circuit board design is concerned.

The DIP and SIP relays are known, but the manner of forming them in order to provide for the proper orientation of the leads has been expensive and somewhat laborious. The steps of making the SIP or DIP relays includes the first step of forming a rectangular frame having four transverse straps in the interior of the frame. A combination of bobbin and switch is positioned adjacent the frame with switch leads in contact with two of the transverse straps, and coil leads are wound on the other two straps. The coil leads are soldered to their respective straps, usually under a microscope. The switch leads are welded to their respective straps. While the frame is intact, with the bobbin and switch connected to it through the soldering and welding operations referred to, a plastic housing is molded around the switch and coil, leaving the respective straps projecting to the sides of a generally elongated plastic housing. Thereafter, the lead frame is trimmed away from the straps and the straps are bent downwardly to complete the formation of the package. The transverse straps for the switch leads project across the frame and the relay becomes a DIP or SIP depending upon which portions of the straps are cut away with the remaining portions of the straps being utilized as connecting points to the circuit board.

An objective of the present invention has been to provide a much more economical SIP or DIP relay. The objective of the invention is attained in part by the elimination of the lead frame and the expense associated with it.

The invention further provides for the formation of a bobbin having the coil terminals embedded in it so as to project from the side of the bobbin. The coil leads can be wound onto the coil terminals with conventional machinery and very simply soldered by dipping the coil terminals with leads wound thereupon into molten solder. Automatic machinery either exists or can be simply modified to provide the winding and soldering operations.

The laterally-projecting switch terminals may be formed in one of two alternative methods. In a first method, the switch leads projecting from the glass envelope are bent into notches or transverse slots lying at the respective ends of the bobbin so as to project as switch terminals to the side of the bobbin. Alternatively, and without changing the bobbin configuration, a separate switch terminal can be placed in the slots in the ends of the bobbin and the switch leads welded to it. The switch terminals project to the side of the bobbin so as to provide the in-line feature.

The thus formed bobbin is thereafter surrounded by a molded plastic housing and the switch terminals and coil terminals bent downwardly to provide the SIP or DIP configuration.

The bobbin is preferably molded upon the glass envelope so as to encase a small portion of the switch leads projecting from the ends of the envelope. The switch leads are thus immobilized so that they may be bent without concern for the problem of fracturing the joint between the leads and the ends of the glass envelope.

In contrast to the prior method of making the SIP and DIP relays which utilize the lead frame, the present invention has the following advantages:

(a) it minimizes the soldering operations;
(b) the first alternative discussed above eliminates the welding of the switch leads to the lead frame;
(c) it eliminates the lead frame and the expense attendant to it;
(d) the coil leads are much more easily wound upon their terminals and thereafter soldered;
(e) the coil terminals are better isolated from the switch leads or terminals;
(f) the invention provides the same versatility of lead position as in the prior method.

The several features of the invention will become more readily apparent from the following detailed description taken in conjunction with the accompanying drawings in which.

Figure 1:
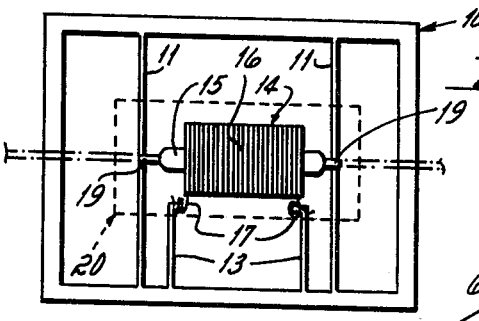
Fig. 1 PRIOR ART
FIG. 1 is a diagrammatic illustration of the prior art method of making SIP or DIP relays.
Figure 2:
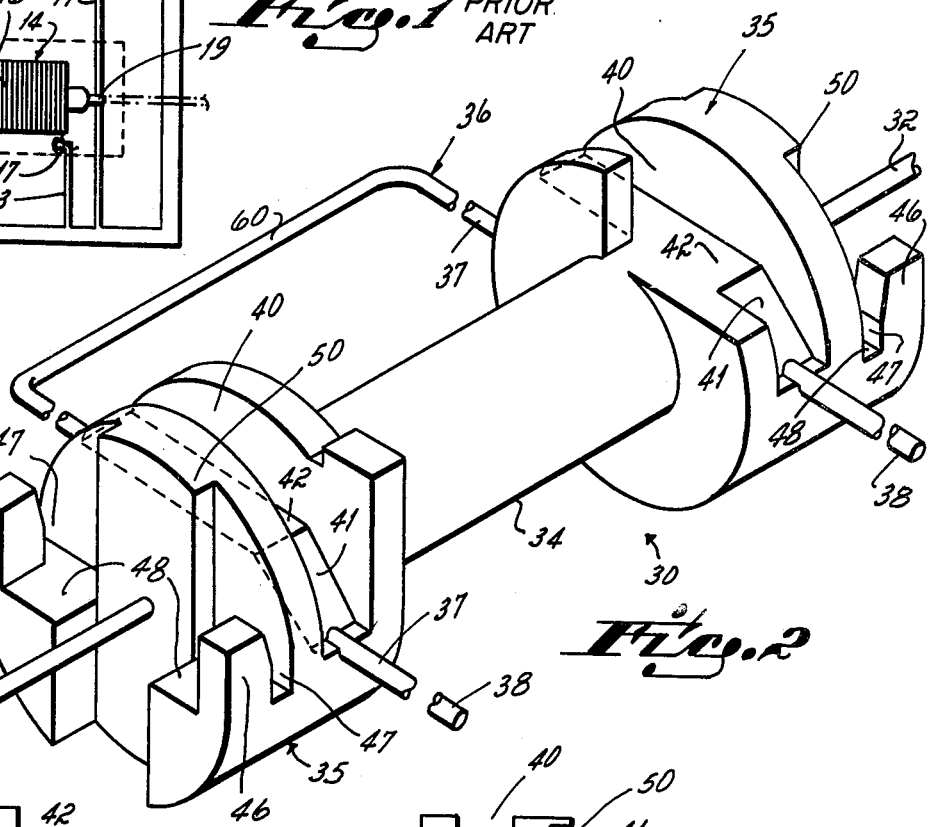
FIG. 2 is a perspective view of the bobbin and switch assembly of the present invention.
Figure 3:
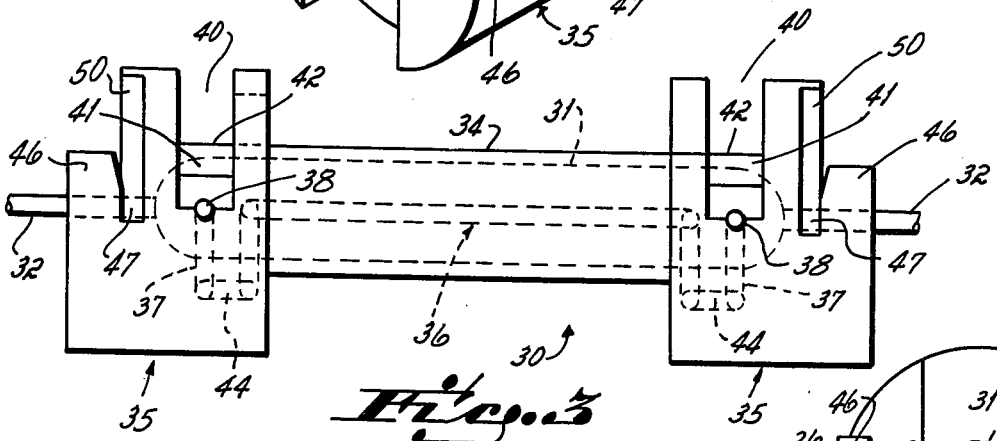
FIG. 3 is a side elevational view of the switch assembly.
Figure 4:
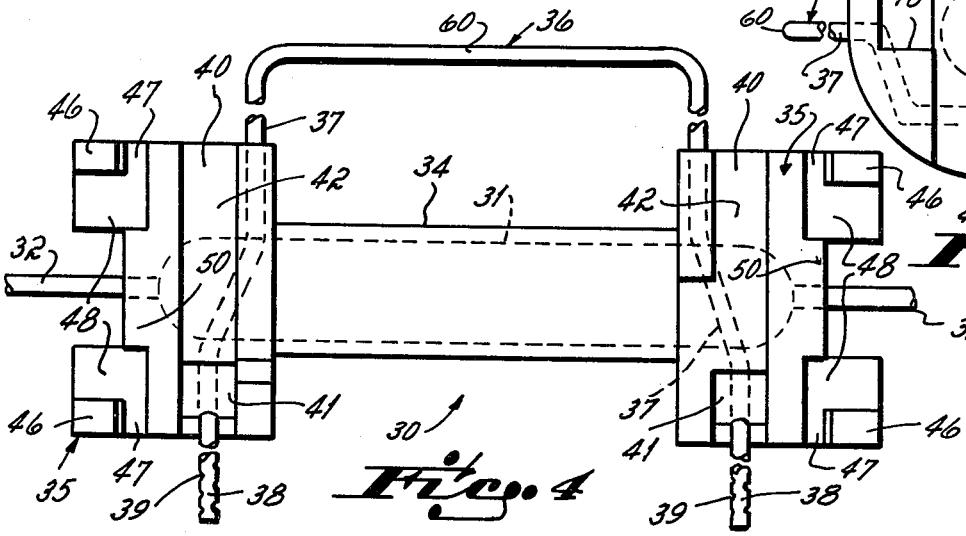
FIG. 4 is a top plan view of the bobbin and switch assembly before trimming the coil terminals.
Figure 5:
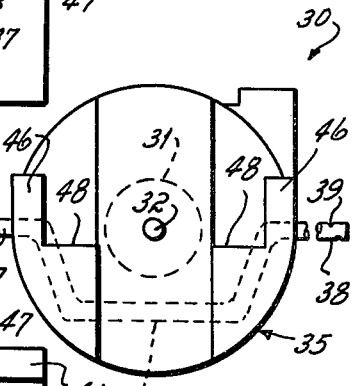
FIG. 5 is an end elevational view of the bobbin and switch assembly.

The prior art method of forming a DIP or SIP relay is illustrated in FIG. 1. A conductive frame 10 is firm formed. The frame is rectangular and has two straps 11 extending from one side of the frame to the other. The frame also has two L-shaped straps 13 extending generally parallel to the straps 11 but only across a portion of the frame. A bobbin 14 having a switch 15 contained in it is juxtaposed with respect to the frame as illustrated. The bobbin has a coil 16 terminating in coil ends 17. The ends of the coil are located adjacent the ends of the straps 13. The switch has leads 19 projecting from either end and lying across the straps 11.

The coil ends 17 are wrapped about the ends of the straps 13 and are soldered thereto, usually under a microscope. The switch leads are welded to the straps 11.

To form the SIP, the upper strap portions 11 are trimmed away and a housing, indicated by broken lines 20, is molded about the bobbin and a portion of the straps. Thereafter, the straps are trimmed away from the main frame and the projecting straps are bent alongside the housing to complete the formation of the relay, the straps forming terminals at one side of the package.

The DIP relay is similarly formed except that the straps 11, as viewed in FIG. 1, are left intact so that the switch lead straps project from both sides of the relay and the coil terminals project from one side of the relay. The molding and terminal bending operations are again performed to complete the formation of the relay.

The bobbin and switch assembly of the present invention is illustrated in FIGS. 2 through 5. The bobbin 30 is molded around a glass envelope 31, the envelope containing the relay contacts and having switch leads 32 projecting from its ends. The molded plastic surrounds a portion of the switch leads adjacent the envelope thereby protecting the juncture against fracture. The bobbin itself has a cylindrical central portion 34 and flanges 35 at each end of the central portion. A U-shaped element 36 which ultimately forms the coil terminals has two legs 37 molded integrally into the coil flanges, the element 36 projecting from both sides of the flanges. The free ends 38 of the element 36 projecting to one side are notched as at 39 and are adapted to receive the coil ends. The portion of the element 36 projecting from the other side will ultimately form the coil terminals, as will be described.

The flanges are substantially identically formed, there being only a slight difference in configuration to accommodate the location of the coil leads at the beginning and ending of the coil winding. Each flange has a coil horn-receiving notch 40, the notch having an inclined surface 41 and a transverse surface 42. These surfaces are adapted to receive the horns or ends 38 of the legs 37 after the coil ends have been soldered to it. The coil terminals are thus well isolated from the switch leads. The central portion of each leg 37 of the element 36 is U-shaped, as shown at 44 in FIG. 5, so as to pass by the glass envelope 31 and is electrically well isolated from it.

Axially outwardly from the notch 40, each flange is configurated to accommodate the switch terminal. The configuration includes a pair of posts 46 on opposite sides of the bobbin, the posts being spaced from the main body of the flange to form a notch 47 on each side of the bobbin. A transverse surface 48 lying in a plane passing approximately through the center of the bobbin forms the bottom of the notches 47. A generally rectangular boss 50 projects from the end of the flange and extends perpendicularly to the surface 48.

The manner in which the relay is completed after the formation of the bobbin and switch assembly of FIGS. 2–5 is illustrated in FIGS. 6–14.

Figure 6:
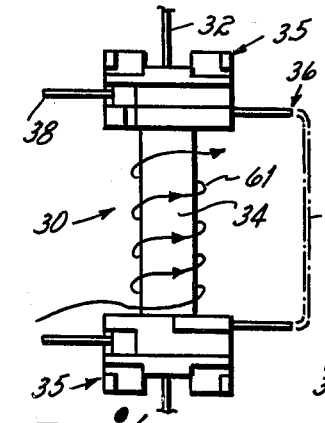
FIGS. 6, 7 and 8 are diagrammatic views illustrating the steps of winding the coil and connecting it to the coil terminals.

Referring to FIG. 6, the bight portion 60 of the coil terminal forming element 36 is trimmed away after molding the bobbin to form coil terminals 63. A coil 61 is wound on the cylindrical portion 34 of the bobbin with leads terminating from each end of the bobbin.

Figure 7:
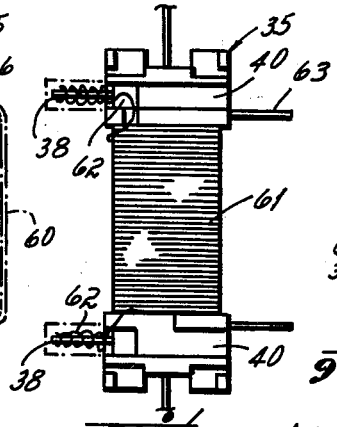
Figure 8:
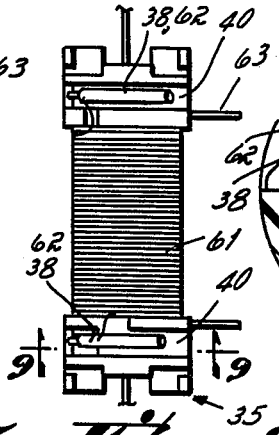
Figure 9:
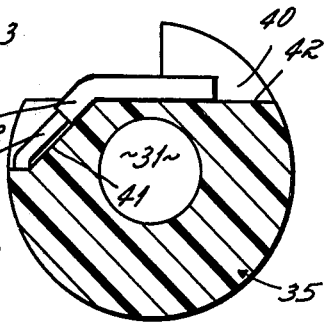
FIG. 9 is a cross-sectional view taken along lines 9—9 of FIG. 8.

As shown in FIG. 7, the coil leads 62 are wrapped about the projecting ends 38 of the element 36 to form the coil horns. The coil horns are dip soldered and are thereafter bent back into the notch 40 at each end of the bobbin 30, as shown in FIG. 8. The orientation of the horns lying on the inclined surface 41 and the transverse surface 42 is illustrated in FIG. 9.

Figure 10:
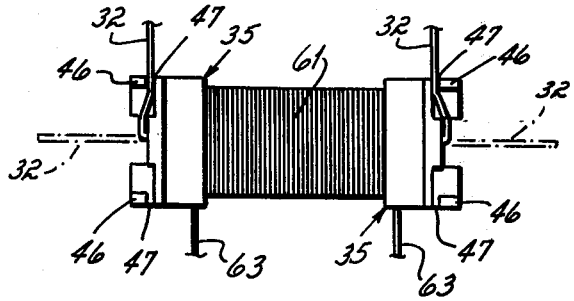
FIG. 10 is a diagrammatic plan view illustrating the first alternative for orienting the switch leads.

One method of providing side oriented switch leads or terminals is illustrated in FIG. 10. In that form of the invention, the projecting switch leads 32 are bent generally at right angles to the axis of the bobbin and into the notch 47 created by the posts 46. If the terminals 32 are bent away from the coil terminals 63, the relay will become a dual in-line package. Alternatively, the switch leads 32 may be bent in the opposite direction to lie in the opposed notches 47 to extend on the same side of the bobbin as the coil terminals 63, thereby forming a single in-line package. After the switch leads are bent into the position, the thus formed bobbin is palced in a mold and a housing 66 is molded around the bobbin, as shown by the phantom lines in FIGS. 12 and 13, with the terminals projecting from the housing. The terminals are thereafter bent downwardly to complete the formation of the relay.

In the alternative form of the invention, a U-shaped switch terminal-forming element 70 has legs 71 which are laid in the respective notches 47 transversely across the bobbin. Each leg 71 has a U-shaped section 72 which contacts the switch lead projecting from the ends of the bobbin adjacent the rectangular boss 50. The switch leads are welded to the legs 71 and the axially projecting excess trimmed off.

Figure 11:
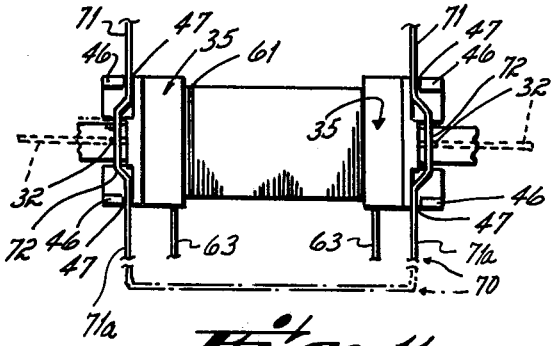
FIG. 11 is a diagrammatic plan view illustrating the alternative method of forming the switch terminals.

The thus formed assembly admits of three options for completing the relay. In accordance with the first option, the lower portion of the element 70, as viewed in FIG. 11, is trimmed away leaving the legs 71 projecting in an opposite direction from the coil terminals 63 to form a dual in-line package. Alternatively, the upper portion of the legs 71 may be trimmed away and only the bight portion of the element 70 trimmed away so that the switch terminals indicated at 71A project from the bobbin on the same side as the coil terminal 63 to form a single in-line package.

The third alternative involves trimming away only the bight portion of the element 70 to provide a relay having switch terminals 71 and 71A projecting from both sides of the bobbin. The switch terminals on one side of the bobbin would ultimately be connected into the electrical circuit, whereas the switch terminals on the opposite side of the bobbin would be used simply to balance the relay to give it stability when it is mounted to the switchboard or to offer a plurality of connections.

Figure 12:
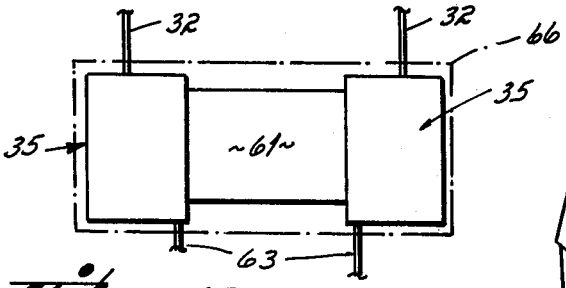
FIG. 12 is a plan view illustrating the molding of the housing around the bobbin.
Figure 14:
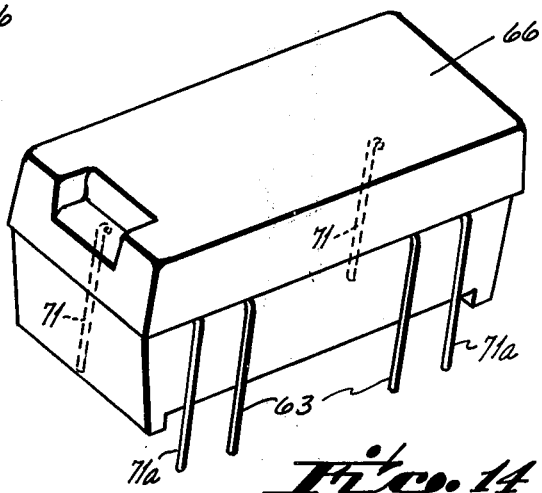
FIG. 14 is a perspective view of the relay of FIG. 11 illustrating the final step in the manufacturing process.
Figure 13:
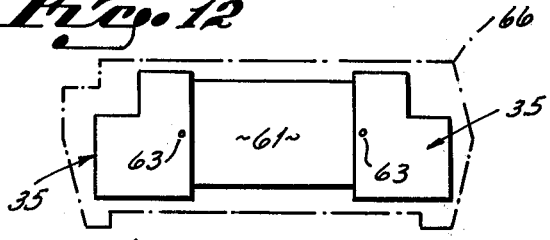
FIG. 13 is a side elevational view illustrating the molding of the housing around the bobbin.

After the switch terminals have been formed on the bobbin in one of the three alternative methods, a housing is molded to the bobbin and the leads bent downwardly, as described in connection with FIGS. 12–14.

The present invention admits of a double pole relay. In the double pole relay, the bobbin configuration is generally the same as described above and the coil and coil horns are formed and laid in their respective notches as described above. The bobbin of course is large enough to accommodate two switches side-by-side with two leads projecting from each end of the bobbin.

Figure 15:
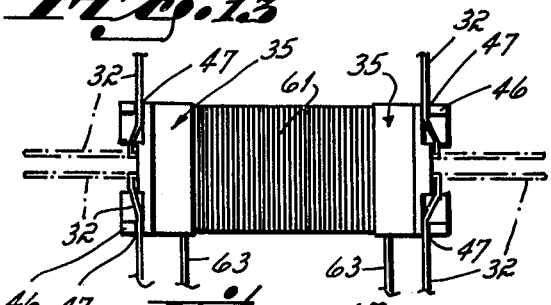
FIG. 15 is a diagrammatic plan view illustrating the application of the invention to a double pole relay.

If the alternative similar to FIG. 10 is employed, the switch leads on both sides of the bobbin are simply bent into the respective notches so that the leads for one switch will project from one side of the bobbin and the switch from the other side will project to the other side of the bobbin (FIG. 15). The molding of the housing is performed as described previously.

Figure 16:
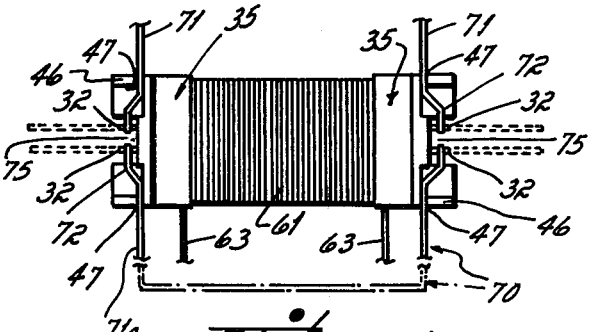
FIG. 16 is a diagrammatic plan view illustrating an alternative form of applying the invention to a double pole relay.

If the alternative similar to FIG. 11 is employed, a similar U-shaped element 70 is laid into the notches 47 and across both switch leads at each end of the bobbin (FIG. 16). The switch leads are welded to the legs of the element 70 and the small portion 75 of each leg 71 between the adjacent switch leads is trimmed away in order to electrically isolate the respective switch leads from each other. A housing is molded to the thus formed assembly and the leads bent as described above.

Having described my invention, I claim:

1. A reed relay comprising,
a bobbin having flanges at each end,
a glass-encapsulated switch located centrally of said bobbin and having a switch terminal projecting from each end,
coil terminals embedded in said flanges and projecting from a side of said bobbin at right angles to the axis of said bobbin,
transverse notches in said flanges,
said switch terminals lying in said notches and projecting to a side of said bobbin at right angles to the axis of said bobbin,
and a housing molded around said bobbin,
said coil and switch terminals lying in at least one plane parallel to the axis of said bobbin.

2. A reed relay as in claim 1 in which said switch terminals are formed by bending the switch leads projecting from said switch and laying them in said notches.

3. A reed relay as in claim 1 in which said switch terminals are formed by placing terminal-forming elements in said notches, said switch terminals being welded to said terminal-forming elements projecting from said bobbin.

4. A reed relay as in claim 1, each said flange having axially inner and outer notches,
said coil terminals having free ends connected to coil leads to form coil horns,
said coil horns lying in said inner notches,
said switch terminals lying in said outer notches.

5. A reed relay as in claim 1 in which said bobbin is molded around said switch.

6. A reed relay comprising,
a bobbin having flanges at each end,
a glass-encapsulated switch located centrally of said bobbin and having a switch terminal projecting from each end,
coil terminals embedded in said flanges and projecting from a side of said bobbin and at right angles to the axis of said bobbin,
transverse notches in said flanges,
said switch terminals having a right angle bend and being disposed in said notches to project from a side of said bobbin at generally right angles to the axis of said bobbin,
and a housing molded around said bobbin,
said coil and switch terminals lying in at least one plane parallel to the axis of said bobbin.

7. In a reed relay including a bobbin surrounding two switches each having a terminal projecting therefrom, coil terminals embedded in said bobbin and a coil wound on said bobbin with coil ends soldered to said terminals thereby forming coil horns, a flange construction at each end of said bobbin comprising,
an inner notch adjacent each said coil horn,
said coil horns being bent and disposed in said inner notches,
an outer transverse notch adjacent each said inner notch,
said outer notch adapted to receive switch terminals selectively projecting from either side of said flange,
a terminal-forming element disposed in the outer notch across the projecting switch terminals and being welded thereto,
the portion of said element between projecting switch terminals being removed to isolate respective switches.

8. The method of forming a reed relay comprising the steps of,
molding a bobbin having flanges at each end,
each flange having inner and outer transverse notches at the side of said bobbin,
a transverse coil terminal projecting in opposite directions from each flange, said coil terminals lying substantially in a plane including the axis of said bobbin,
disposing a switch in said bobbin with said switch having axially projecting terminals,
winding a coil on said bobbin,
soldering the coil leads to said coil terminals at one side of said bobbin to form coil horns,
bending the coil horns into said inner notches, and
disposing switch terminals in said outer notches to lie in at least one plane parallel to the axis of said bobbin.

9. The method as in claim 8 further comprising the step of bending said switch terminals into said outer notches to project transversely from said bobbin,
molding a housing around said bobbin.

10. The method as in claim 9 in which said switch terminals project from said bobbin on the same side as said coil terminals, said switch and coil terminals lying in a single plane parallel to the axis of said bobbin.

11. The method as in claim 8 further comprising the steps of,
placing terminal-forming elements in said outer notches extending transversely to said bobbin axis,
electrically connecting said switch terminals to said terminal-forming elements,
and molding a housing around said bobbin.

12. The method of forming a reed relay comprising the steps of,
molding a bobbin having flanges at each end,
each flange having inner and outer transverse notches,
a transverse coil terminal projecting in opposite directions from each flange,
a pair of switches disposed in said bobbin and having axially projecting terminals,
winding a coil on said bobbin,
soldering the coil leads to said coil terminals at one side of said bobbin to form coil horns,
bending the coil horns into said inner notches,
placing a terminal-forming element in each of said outer notches, welding said switch terminals to said terminal elements, removing the portion of said terminal-forming element between said switch terminals, and molding a housing around said bobbin.

13. The method as in claim 12 further comprising the step of, removing a portion of the terminal-forming element extending to one side of said switch terminal.

* * * * *